US008161930B2

(12) United States Patent
Elendt et al.

(10) Patent No.: US 8,161,930 B2
(45) Date of Patent: Apr. 24, 2012

(54) CAMSHAFT FOR A VARIABLE LIFT VALVE TRAIN OF AN INTERNAL COMBUSTION ENGINE

(75) Inventors: Harald Elendt, Altendorf (DE); Andreas Nendel, Hessdorf (DE)

(73) Assignee: Schaffler Technologies AG & Co. KG, Herzogenaurach (DE)

( * ) Notice: Subject to any disclaimer, the term of this patent is extended or adjusted under 35 U.S.C. 154(b) by 354 days.

(21) Appl. No.: 12/610,448

(22) Filed: Nov. 2, 2009

(65) Prior Publication Data

US 2010/0108006 A1 May 6, 2010

(30) Foreign Application Priority Data

Oct. 31, 2008 (DE) ..... 10 2008 054 254

(51) Int. Cl.
*F01L 1/04* (2006.01)

(52) U.S. Cl. ..... 123/90.6; 123/90.16; 123/90.44; 29/888.1

(58) Field of Classification Search ..... 123/90.16, 123/90.44, 90.6; 29/888.1
See application file for complete search history.

(56) References Cited

U.S. PATENT DOCUMENTS 7,305,953 B2 * 12/2007 Walz ..... 123/90.6

FOREIGN PATENT DOCUMENTS

| | | |
|---|---|---|
| DE | 10148177 | 4/2003 |
| DE | 102004022849 | 12/2005 |
| DE | 102004024219 | 1/2006 |
| EP | 0798451 | 4/1999 |

* cited by examiner

*Primary Examiner* — Ching Chang
(74) *Attorney, Agent, or Firm* — Volpe and Koenig, P.C.

(57) ABSTRACT

A camshaft (1) is provided for a stroke-variable valve drive of an internal combustion engine with a carrier shaft (2) and a cam part (3) that is arranged locked in rotation and movable in the axial direction on the carrier shaft and that is assembled from a cam carrier (4) and a sleeve (5). The cam carrier has a cam group (7, 8) of directly adjacent cams (9, 10, 11, 12) with different cam strokes and an adapter end (6) on which the sleeve is mounted. The sleeve has a setting groove (17) in the form of a groove that extends across an extent of the sleeve and that is used for the specification of an axial setting groove track for an activation pin (18) moving the cam part on the carrier shaft. The setting groove is produced in the sleeve through non-metal-cutting shaping of sheet-metal material.

8 Claims, 1 Drawing Sheet

CAMSHAFT FOR A VARIABLE LIFT VALVE TRAIN OF AN INTERNAL COMBUSTION ENGINE

CROSS-REFERENCE TO RELATED APPLICATIONS

This application claims the benefit of German Patent Application No. DE 10 2008 054 254.7, filed Oct. 31, 2008, which is incorporated herein by reference as if fully set forth.

BACKGROUND

The invention relates to a camshaft for a variable lift valve train of an internal combustion engine. The camshaft comprises a carrier shaft and a cam part that is arranged locked in rotation and movable in the axial direction on this carrier shaft and that is assembled from a cam carrier and a sleeve. The cam carrier has a cam group of directly adjacent cams with different cam strokes and an adapter end on which the sleeve is mounted. The sleeve has a setting groove in the form of a groove that extends at least in some sections across the periphery of the sleeve and that is used for specifying an axial setting groove track for an activation pin moving the cam part on the carrier shaft.

In contrast to switchable cam followers that vary the transmission of cam strokes to gas-exchange valves as a function of their switching state, the valve drive variability in the present camshaft is based on cam parts that can be displaced in the axial direction and whose different cam elevations are in selective engagement with a rigid cam follower. The functional principle of a valve drive with such a camshaft emerges in detail from EP 0 798 451 B1.

A camshaft with a structural configuration according to the class is proposed, for example, in DE 10 2004 022 849 A1, while a construction of the sleeve mounted on the cam carrier for specifying the setting groove track is described in more detail in DE 10 2004 024 219 A1. In these publications, the sleeve mounted on the adapter end of the cam carrier is produced as a separate component made from a steel alloy or a sintered metal. In both cases, however, metal-cutting machining or finishing work is absolutely required on the setting groove formed as a groove, because the spiral-shaped, curved groove walls act as an undercut and, in this respect, the required deformability of a foundry, casting, or sintering mold producing the sleeve as a finished part would not be given. For this reason, the sleeves known in the state of the art can be produced only with high processing and consequently high cost expenditure for the metal-cutting machining or finishing work of the groove.

SUMMARY

The present invention is therefore based on the objective of improving a camshaft of the type named above to the extent that it can be produced with the same functionality in a way that is suitable for mass production and that is, in particular, economical.

This is accomplished according to the invention in that the setting groove is produced by non-metal-cutting shaping of sheet-metal materials for the sleeve that has a tubular base body and collars attached to this base body on the ends, wherein the outer casing of the base body is used as the base of the groove and the insides of the collars are used as the walls of the groove. In other words, it is proposed to generate the geometrically extremely complex setting groove that could only be produced until now with high expense using non-metal-cutting processes and known, more economical sheet-metal shaping processes.

In one embodiment of the invention it is provided that the collars extend merely across a partial extent of the base body that is brought together to form a tubular shape with a positive or material fit at a longitudinal joint running outside of this partial extent. This construction takes advantage of the condition that the axial displacement of the cam part can take place only during the common base circle phase of the cams and accordingly the groove does not have to extend across the total extent of the sleeve with its walls. The shaping process of the sleeve can then be tailored so that initially a straight sheet-metal strip is produced with the angled collars used as walls of the groove and the sheet-metal profile formed in this way is bent to form the tubular shape of the sleeve with a reasonable deformation degree and is connected at its longitudinal ends. The longitudinal ends should advantageously form a butt longitudinal joint and should be fused with each other. Alternatively, however, an overlapping longitudinal joint could also be provided with a positive-fit connection of the longitudinal ends, such as, for example, a dovetail joint or a point-shaped or linear clinch joint. As an alternative to the mentioned connections by longitudinal joints, there is also the possibility to fuse the sleeve made from two ring bodies lying one next to the other on the ends, wherein the collars can be shaped either before or after the fusing, for example, by deep-drawing or flanging processes.

In addition, the setting groove should be formed to define two setting groove tracks intersecting at an intersection point, wherein the collars run mirror-symmetric to a transverse middle plane of the sleeve and have—with respect to the rotational direction of the cam part—a decreasing spacing before the intersection point and an increasing spacing after the intersection point. As is known from DE 101 48 177 A1, such a setting groove allows the displacement of the cam part in both axial directions, wherein, in the case of a cam group with two cams, only one activation pin is required.

Furthermore, the base of the groove should be provided with a locally shaped radial elevation that is used as the return ramp driving the activation pin from the setting groove. As is usually provided in such valve drives, the activation pin is part of an actuator that brings the activation pin actively in engagement with the setting groove at a specified angular position of the camshaft. The excursion movement of the activation pin from the setting groove required according to the displacement process of the cam part is realized, in contrast, in a passive way, in that the activation pin is driven by the ramp-shaped radial elevation from the setting groove in the disengaged rest position of the actuator.

In a construction that is simple with respect to production, the radial elevation on the base body should be formed like a tongue. The radial elevation, however, could also be constructed, for the benefit of increased stiffness of both the sleeve and also the radial elevation itself, as a closed formation similar to a ramp-like bead on the base body.

In the case of a multi-valve internal combustion engine, i.e., for at least two intake and/or exhaust valves for each cylinder of the internal combustion engine, it is also provided that the cam carrier has two of the mentioned cam groups and a cylindrical section extending between these groups for supporting the cam part at a camshaft bearing point of the internal combustion engine. Here, the adapter end should run on an end section of the cam carrier. This construction allows several identical gas-exchange valves, i.e., intake or exhaust valves of the allocated cylinder, to be activated with the same cam part and corresponds to the preferred cylinder head architecture of modern internal combustion engines, in which the camshaft is not supported at bearing points between the cylinders, but instead between the intake or exhaust valves of a cylinder.

Furthermore, the sleeve should be mounted on the adapter end by an interference fit assembly.

Finally, the features and constructions noted above are also able to be combined with each other in various manners, as far as this is possible and useful.

BRIEF DESCRIPTION OF THE DRAWINGS

Additional features of the invention emerge from the following description and from the drawings in which a preferred embodiment of the invention is shown. Shown are.

DETAILED DESCRIPTION OF THE PREFERRED EMBODIMENT

Figure 1:
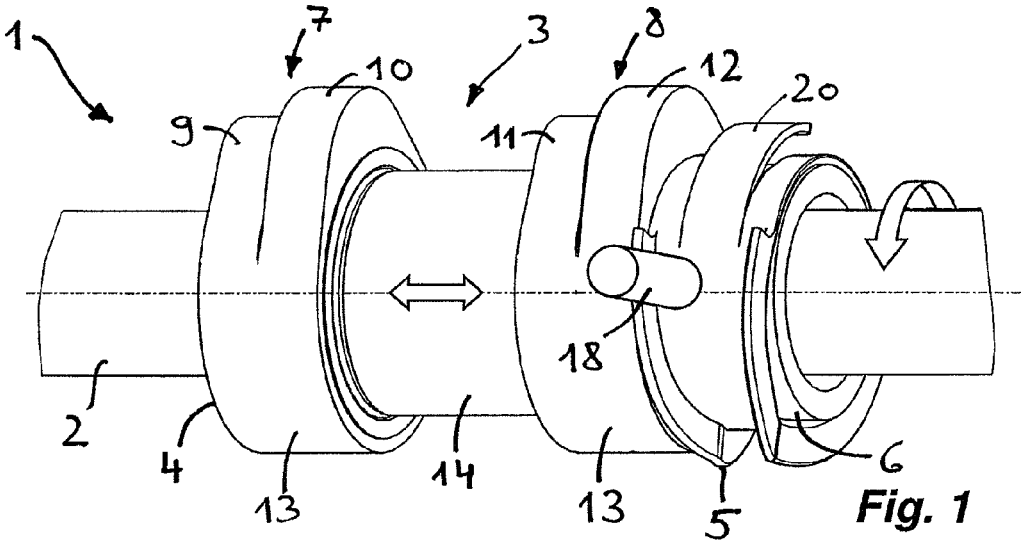
FIG. 1 is a perspective view of a cam part assembled from a cam carrier and a sleeve.

In FIG. 1, a section of a camshaft 1 for a variable lift valve train of an internal combustion engine that is essential for the understanding of the invention is disclosed. The camshaft 1 comprises a carrier shaft 2 with external longitudinal teeth and, for each cylinder of the internal combustion engine, a cam part 3 that is arranged locked in rotation with corresponding internal longitudinal teeth and movable in the axial direction on the carrier shaft 2. The cam part 3 is assembled from a cam carrier 4 and a sleeve 5 that is pressed on an adapter end 6 of the cam carrier 4 with defined radial orientation. The sleeve 5 can be provided for the purpose of precise orientation relative to the cam carrier 4 with an end-side marking not shown here.

The cam carrier 4 has two cam groups 7, 8 each with a pair of cams 9, 10 and 11, 12, respectively, directly adjacent to each other, which have different cam strokes while having the identical base circle 13 for the variable activation of cam followers (not shown) and gas-exchange valves. For supporting the cam part 3 at a similarly not-shown camshaft bearing point of the internal combustion engine, a cylindrical section 14 of the cam carrier 4 running between the cam groups 7, 8 is used.

The sleeve 5 which is active for both displacement directions of the cam part 3 is merely provided on an end section of the cam carrier 4. As is clear from an overview of FIGS. 2 and 3 in which the sleeve 5 is shown in different angular positions as a separate part, the sleeve 5 is an integral component produced from sheet-metal material by non-metal-cutting, cold forming. This component is assembled geometrically from a tubular base body 15 and collars 16 attached to the body 15 on the ends, so that a setting groove 17 is formed in the shape of a groove extending in some sections across the extent of the sleeve 5. The outer casing of the base body 15 is used as the base of the groove 17 and the insides of the collars 16 are used as the walls of the groove 17. The function of the groove 17 involves the specification of an axial setting groove track for an activation pin 18 that can be coupled in the radial direction in the setting groove 17 and that moves the cam part 3 back and forth on the carrier shaft 2 according to the double-headed arrow. The activation pin 18 is part of a known actuator not shown here in more detail.

The starting point in the production of the sleeve 5 is an elongated sheet-metal strip on which the collars 16 are formed in some sections and that is subsequently bent into a circular shape. The collars 16 formed in some sections extend accordingly only across a partial extent of the base body 15 that is brought together to form the tubular shape at a fused longitudinal joint 19 outside of this partial extent.

In the vicinity of the longitudinal joint 19 there is a locally formed radial elevation 20 that is shown here with a tongue-like shape and whose task is driving the activation pin 18 at the end of the displacement process of the cam part 3 from the setting groove 17 into its retracted rest position. As also becomes clear from FIG. 1, the radial elevation 20 has the shape of a ramp that is oriented for the illustrated rotational direction of the camshaft 1 corresponding to the sleeve 5.

Both the radial elevation 20 and also the collars 16 run mirror symmetric to a transverse middle plane of the sleeve 5 that is provided in the present embodiment with a so-called X-groove 17. This is to be understood such that the setting groove 17 is formed for the specification of two setting groove tracks 22, 23 intersecting at an intersection point 21. The setting groove tracks 22 and 23 that are symbolized in FIG. 2 by the dotted lines describe the movement of the activation pin 18 coupled in the setting groove 17 relative to the extent of the base body 15 during the displacement of the cam part 3 on the carrier shaft 2. The profile of this movement essentially corresponds to the shaping of the collars 16 that have—with respect to the drawn rotational direction of the cam part 3—a decreasing spacing before the intersection point 21 and an increasing spacing after the intersection point 21. Because the collars 16 are attached to the base body 15 on the ends, this has a correspondingly narrow construction in the region of the intersection point 21.

Figure 2:
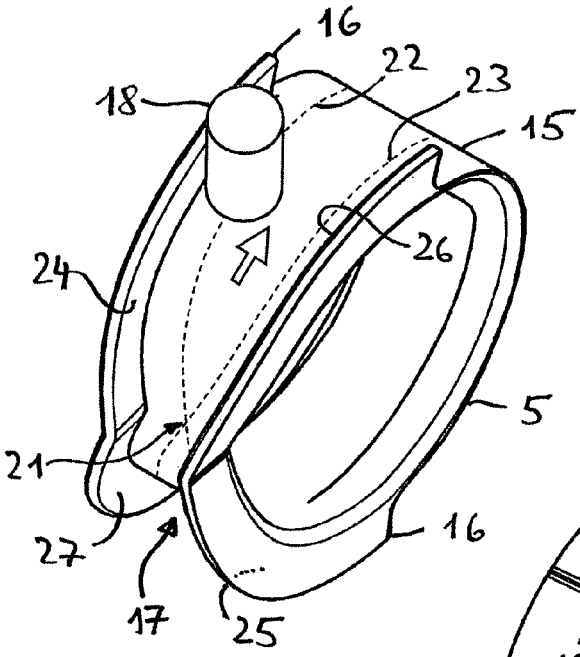
FIG. 2 is a first perspective view of the sleeve.
Figure 3:
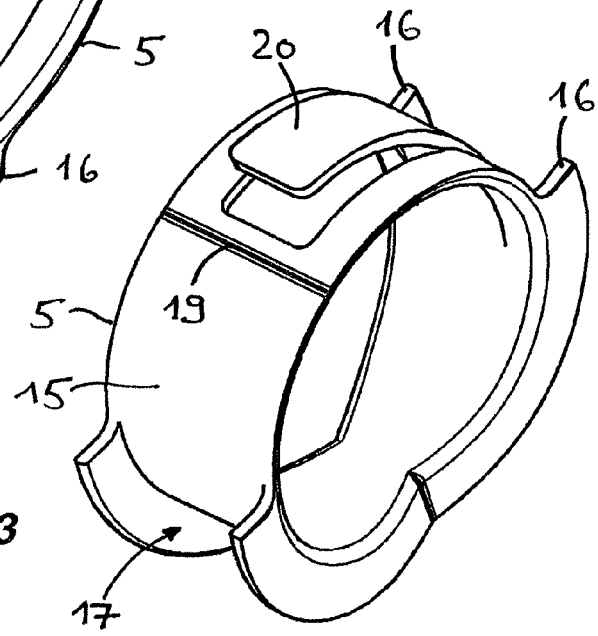
FIG. 3 is a second perspective view of the sleeve.

Below, the interaction of the activation pin 18 with the setting groove 17 is explained for the displacement of the cam part 3 during the common base circle 13 of the cams 9, 10 and 11, 12. In FIG. 2, the activation pin 18 is already engaged with the setting groove 17 rotating in the arrow direction, in order to shift the cam part 3 corresponding to the setting groove track 22 from the right at the front towards the left at the back relative to the carrier shaft 2. The cam part 3 is supported on the activation pin 18 initially with the collar section 24 advancing the cam part 3 and then, after passing the intersection point 21 due to the axial mass inertia of the cam part 3, with the collar section 25 retarding the cam part 3. At the end of the displacement process according to FIG. 1, the activation pin 18 is lifted by the ramp-shaped radial elevation 20 and driven from the setting groove 17 into its disengaged rest position.

The cam part 3 is shifted back—in FIG. 2 corresponding to the setting groove track 23 from the left at the back towards the right at the front—in an analogous way through renewed coupling of the activation pin 18 in the setting groove 17, wherein now the cam part 3 is supported on the activation pin 18 with the collar section 26 advancing the cam part 3 and, after passing the intersection point 21, with the collar section 27 retarding the cam part 3.

The width of the radial elevation 20 is dimensioned so that it is used in both displacement directions as the return ramp driving the activation pin 18 from the setting groove 17.

REFERENCE SYMBOLS

1 Camshaft
2 Carrier shaft
3 Cam part
4 Cam carrier
5 Sleeve
6 Adapter end
7 Cam group
8 Cam group

9 Cam
10 Cam
11 Cam
12 Cam
13 Base circle
14 Cylindrical section
15 Base body
16 Collar
17 Setting groove/groove
18 Activation pin
19 Longitudinal joint
20 Radial elevation
21 Intersection point
22 Setting groove track
23 Setting groove track
24 Advancing collar section
25 Retarding collar section
26 Advancing collar section
27 Retarding collar section

The invention claimed is:

1. A camshaft for a variable lift valve train of an internal combustion engine, comprising a carrier shaft and a cam part that is arranged locked in rotation and movable in an axial direction on the carrier shaft, the cam part includes a cam carrier and a sleeve, the cam carrier has a cam group of directly adjacent cams with different cam strokes and an adapter end on which the sleeve is mounted, and the sleeve has a setting groove formed as a groove that extends at least in some sections across an extent of the sleeve and that is used for specification of an axial setting groove track for an activation pin that moves the cam part on the carrier shaft, the setting groove is produced in the sleeve by non-metal-cutting shaping of sheet-metal material and has a tubular base body and collars attached to the base body on both ends, the outer casing of the base body is used as a base of the setting groove and insides of the collar are used as walls of the setting groove.

2. The camshaft according to claim 1, wherein the collars extend across a partial extent of the base body, and the base body is brought together into a tubular shape with a positive or material fit at a longitudinal joint that extends outside of the partial extent with the collars.

3. The camshaft according to claim 2, wherein the base body is fused at the longitudinal joint.

4. The camshaft according to claim 1, wherein the setting groove is formed for specification of two setting groove tracks that intersect at an intersection point, the collars extend mirror symmetric to a transverse middle plane of the sleeve and have, with respect to a rotational direction of the cam part, a decreasing spacing before the intersection point and an increasing spacing after the intersection point.

5. The camshaft according to claim 1, wherein the base of the setting groove is provided with a locally shaped radial elevation that is used as a return ramp to drive the activation pin from the setting groove.

6. The camshaft according to claim 5, wherein the radial elevation is formed on the base body with a tongue shape.

7. The camshaft according to claim 1, wherein the cam carrier has two of the cam groups and a cylindrical section extending between the cam groups for supporting the cam part at a camshaft bearing point of the internal combustion engine, and the adapter end extends from one end section of the cam carrier.

8. The camshaft according to claim 1, wherein the sleeve is mounted on the adapter end by an interference fit assembly.

* * * * *